United States Patent [19]

Prossel et al.

[11] 4,122,257

[45] Oct. 24, 1978

[54] BENZOFURAN-OXADIAZOLE COMPOUNDS

[75] Inventors: Günter Prossel, Kelkheim; Erich Schinzel, Hofheim am Taunus; Günter Rösch, Bad Soden am Taunus, all of Fed. Rep. of Germany

[73] Assignee: Hoechst Aktiengesellschaft, Frankfurt am Main, Fed. Rep. of Germany

[21] Appl. No.: 802,366

[22] Filed: Jun. 2, 1977

[30] Foreign Application Priority Data

Jun. 4, 1976 [CH] Switzerland ..... 7119/76

[51] Int. Cl.[2] ..... C07D 407/04; C07D 407/06; C07D 407/10; C07D 407/14

[52] U.S. Cl. ..... 542/432; 542/454; 542/458; 260/307 G; 252/301.24; 252/301.28

[58] Field of Search ..... 260/307 G, 307 D; 542/458, 466, 454, 464, 466, 432

[56] References Cited

U.S. PATENT DOCUMENTS

| | | | |
|---|---|---|---|
| 3,859,350 | 1/1975 | Sahm et al. | 542/466 |
| 4,039,555 | 8/1977 | Sahm et al. | 260/307 G |

OTHER PUBLICATIONS de Buman et al, Heh. Chim. Acta., 57 (1974), pp. 1352–1373.

*Primary Examiner*—Allen B. Curtis
*Attorney, Agent, or Firm*—Connolly and Hutz

[57] ABSTRACT

Furanyl-(2)-1,2,4-oxadiazoles of the formula wherein

A represents an aromatic mononuclear or binuclear ring system which with two adjacent carbon atoms is fused with the furan nucleus in the manner indicated, R represents hydrogen, a lower alkyl group, an optionally substituted phenyl group, as well as an optionally functionally modified carboxy group, X represents a direct bond, as well as the following divalent radicals B represents a straight-chained or branched, optionally substituted alkyl group or an optionally substituted aryl or heteroaryl group.

These compounds are suitable for the optical brightening of high molecular weight organic substances, especially for textile materials of synthetic polymers.

2 Claims, No Drawings

BENZOFURAN-OXADIAZOLE COMPOUNDS

Benzofuran compounds, which are linked by a stilbene bridge to the 3-phenyl-1,2,4-oxadiazolyl-(5)-radical, have already been described (Helv. Chim. Acta 57, 1370 (1974). As their fluorescence maximum is from 485 to 490 nm, however, these known compounds are not suitable for use as optical brighteners. It has now been found that the fluorescence maximum of colorless to slightly yellow-colored furanyl-(2)-1,2,4-oxadiazoles of the following general formula (1)

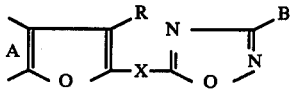

is in the desired range of 410 to 450 nm and they are therefore excellently suitable for the optical brightening of high molecular weight organic substrates. In formula (1), A represents an aromatic mononuclear or binuclear ring system which with two adjacent carbon atoms is fused with the furan nucleus in the manner indicated, R represents hydrogen, a lower alkyl group, an optionally substituted phenyl group, as well as an optionally functionally modified carboxy group, X represents a direct bond, as well as the following divalent radicals

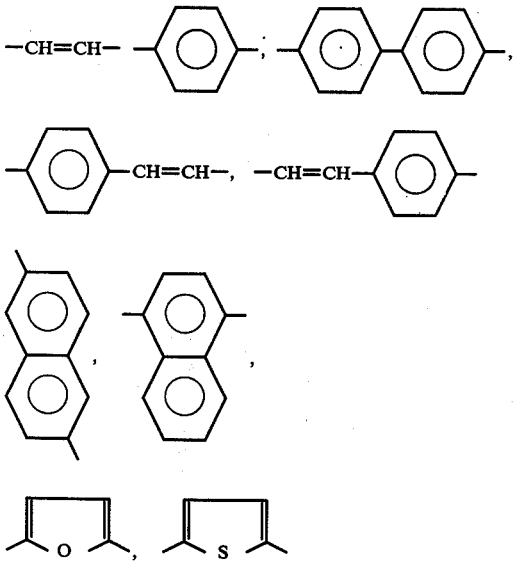

B represents a straight-chained or branched, optionally substituted alkyl group or an optionally substituted aryl or heteroaryl group.

There may be bonded to the aromatic ring system A non-chromophoric substituents, that is, preferably lower alkyl, alkenyl, alkoxy, aryl, preferably phenyl, optionally functionally modified carboxy or sulfo groups, acyl, acylamino or sulfonyl groups as well as halogen atoms. It is also possible for several of either the same or different groups mentioned to be simultaneously bonded to A.

The expression "lower" used in connection with aliphatic radicals shall indicate groups having up to 4 carbon atoms.

In the definitions given for A and R, there is to be understood by a functionally modified carboxy group chiefly the salts thereof with colorless cations, alkali metal or ammonium ions being preferred, and furthermore especially the cyano group, carboxylic acid ester groups or carboxylic acid amide groups. There are to be understood by carboxylic acid ester groups especially those of the general formula $COOR^1$, in which $R^1$ represents a phenyl radical or an optionally branched lower alkyl group, wherein these radicals may contain other substituents, such as a preferably lower molecular weight dialkylamino, trialkylammonium or alkoxy group. There is to be understood by a carboxylic acid amide group especially one of the formula $CONR^2R^3$, in which the radicals $R^2$ and $R^3$ represent hydrogen atoms or lower, optionally substituted alkyl groups, which may also form, together with the nitrogen atom, a hydroaromatic ring, and furthermore acid hydrazides of the formula $CONHNR^2R^3$, in which $R^2$ and $R^3$ have the above-mentioned meanings, and the analogous thio derivatives.

There is to be understood by a functionally modified sulfo group — in analogy with the above comments — salts with colorless cations, preferably alkali metal or ammonium ions, and furthermore derivatives in which the $SO_2$-group is bonded to a hetero atom, as in the sulfonic acid ester group and in the sulfonamide group. There is to be understood by a sulfonic acid ester group, especially one of the formula $SO_2OR^1$, in which $R^1$ has the above meaning, and by sulfonic acid amide group, one of the formula $SO_2NR^2R^3$, in which $R^2$ and $R^3$ have the meanings given above.

There is to be understood by an acyl group, especially one of the formula $COR^4$, in which $R^4$ represents an optionally substituted, preferably lower alkyl or phenyl radical.

There is to be understood by a sulfonyl radical, especially one of the formula $SO_2R^5$, in which $R^5$ represents an optionally substituted lower alkyl or phenyl group, wherein these groups may contain as substituents, preferably a lower dialkylamino, trialkylammonium, acylamino or sulfo group.

Of the definitions given for B there are to be understood in particular: methyl, ethyl, n- or i-propyl, n- or i-butyl, pentyl, β-chloroethyl, β-dimethylaminoethyl or β-diethylaminoethyl, N-β-morpholinoethyl, N-β-piperidinoethyl, N-β-(N'-methylpiperazino)ethyl, benzyl, phenoxymethyl, β-phenoxyethyl, β-chlorophenoxyethyl, β-ethylmercaptoethyl, β-phenylmercaptoethyl, or the radicals of the formulae $CH_2CH_2OCH_3$, $CH_2CH_2OC_2H_5$, $CH_2CH_2OC_3H_7$, $CH_2CH_2OC_4H_9$, $CH_2CH_2OC_6H_{13}$,

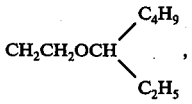

$CH_2CH_2OC_6H_{11}$, $(CH_2CH_2O)_2CH_3$, $(CH_2CH_2O)_2C_2H_5$, $(CH_2CH_2O)_2C_4H_9$, $(CH_2CH_2O)_3C_2H_5$, $CH_2Ch_2OCH_2CH_2SC_2H_5$, $CH_2CH_2OCH_2CH_2$-$N(CH_3)_2$, $CH_2CH_2OCH_2CH_2$-$N(C_2H_5)_2$ or

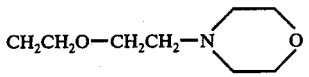

Preferred are the compounds of the formula (2)

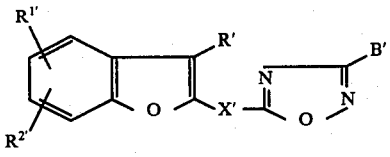

(2)

in which $R^{1'}$ and $R^{2'}$ represent H, lower alkyl groups, lower alkoxy groups, halogen atoms, optionally substituted phenyl groups, optionally functionally modified carboxy groups, or $R^{1'}$ and $R^{2'}$ together represent a fused benzene nucleus $R'$ represents H or a lower alkyl group $X'$ represents the following divalent radicals

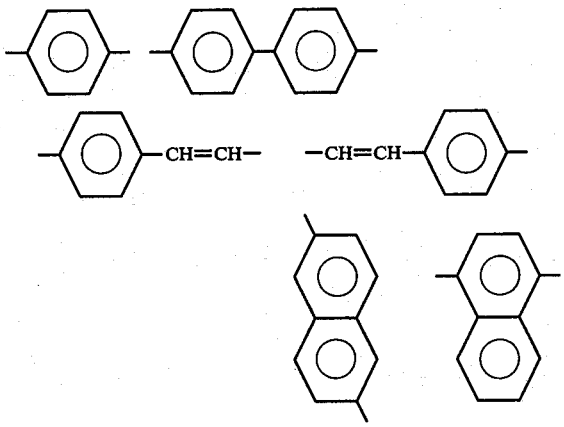

and $B'$ represents a lower alkyl having 1–6 carbon atoms, an alkoxyalkyl group or an optionally non-chromophorically substituted phenyl radical and furthermore the groupings

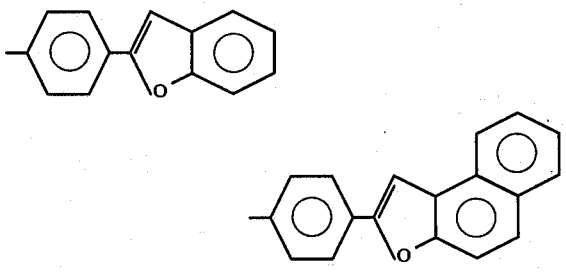

The compounds of the general formula (3)

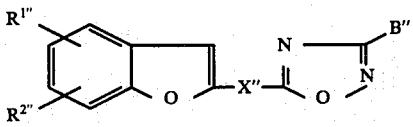

(3)

in which $R''$ and $R^{2''}$ represents a hydrogen atom, a $C_1$–$C_4$ alkyl group, a $C_1$–$C_4$ alkoxy group, a halogen atom or a benzene ring fused in the 4,5-position, $X''$ represents the following divalent bridge members

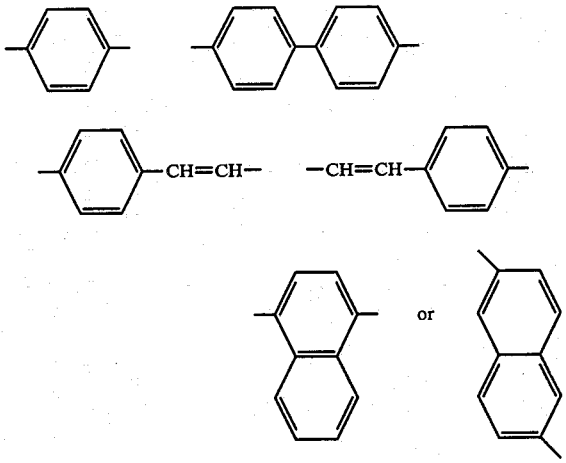

and $B''$ represents a $C_1$–$C_6$ alkyl group, a $C_1$–$C_4$ alkoxyalkyl group, a phenyl group, a $C_1$–$C_4$ alkylphenyl group, a halophenyl group or a $C_1$–$C_4$ carboalkoxyphenyl group or a group of the formula

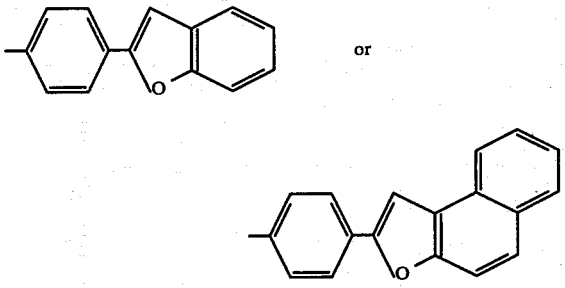

are of particular interest.

The compounds according to the invention can be produced according to the following process:

(A) 1 mole of a carboxylic acid chloride of the general formula (4)

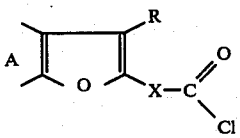

(4)

is reacted with 1 mole of an amide oxime of the general formula (5)

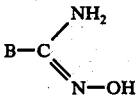

(5)

or the salt thereof, preferably in the presence of an acid-binding agent in an inert solvent at temperatures of 20°–200° C., preferably at 160°–180° C., wherein A, B, R and X in the formulae (4) and (5) have the meanings given for formula (1)

Suitable solvents for the reaction are, for example, ethylene chloride, chlorobenzene, dichlorobenzene or trichlorobenzene and especially dimethyl formamide, N-methylpyrrolidone, dimethylsulfoxide or nitrobenzene. Acid-binding agents are, for example, $Na_2CO_3$, $K_2CO_3$, $CaCO_3$ or tertiary amines. After a reaction time of one to two hours, HCl and $H_2O$ are split off to yield directly the compounds of the general formula (1), which on cooling the reaction mixture crystallise out in a good yield and are practically pure.

The starting substances of the formula (4) and (5) are known or are produced in a manner analogous to processes known per se (German Offenlegungsschrift No. 2 238 628). Thus, the starting compounds of the formula 4 are obtained by reacting compounds of the formula 6

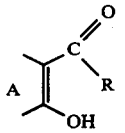

(6)

with compounds of the formula $ClCH_2 - X - CN.$

Subsequently the cyano group is hydrolized to form the carboxy group and the carboxy group is converted into the acid chloride group. The corresponding starting compounds for the production of the compounds of the general formulae 2 and 3 are produced in an analogous manner. The production of the compounds of the formula (5) is effected by reacting the cyano com-

B—CN with hydroxylamine hydrochloride in ethanol/water at 80° C. Subsequently the base is released by adding soda.

(B) In accordance with the following reaction scheme

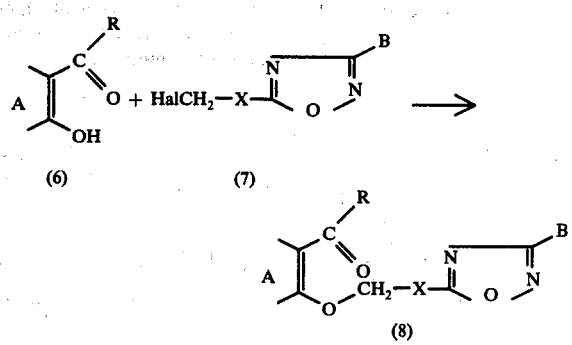

(6) (7) (8)

1 mole of an aldehyde of the formula (6) is etherified with 1 mole of a halomethyl compound of the formula (7) to form the compound of the general formula (8), which is then cyclized, preferably in the form of its anil, with alkali metal hydroxides, in polar solvents, such as dimethylformamide, hexamethyl phosphoric acid trisamide, diethylformamide or dimethylacetamide, at 0° to 160° C., or without solvents in an alkali melt at 200° to 400° C., to form (1).

The following survey provides further explanation but is not intended to limit the present invention.

It is possible to use, for example, the following compounds as carboxylic acid chlorides of the general formula (4) in process A).

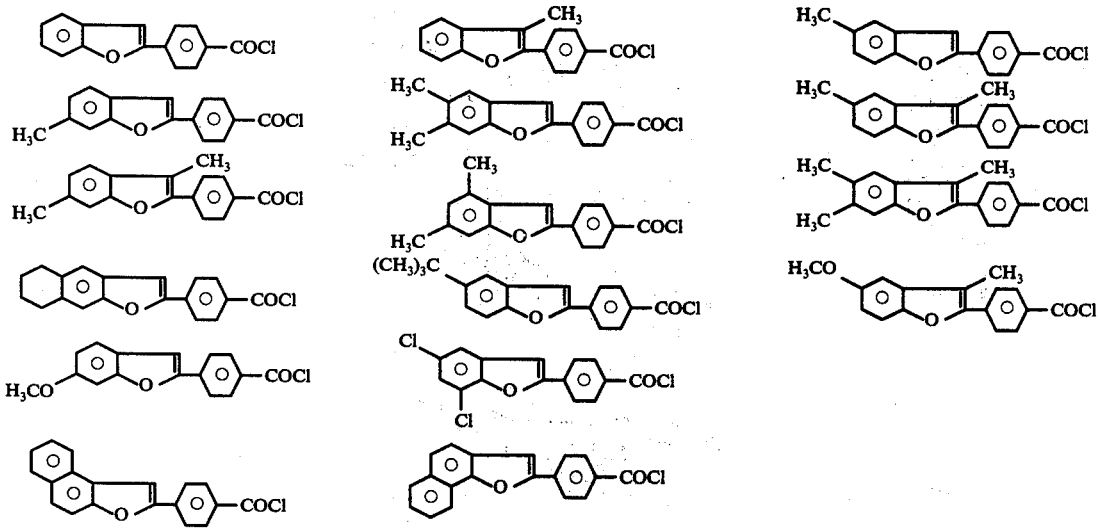

pounds of the formula

There may be used as amide oximes of the general formula (5), for example:

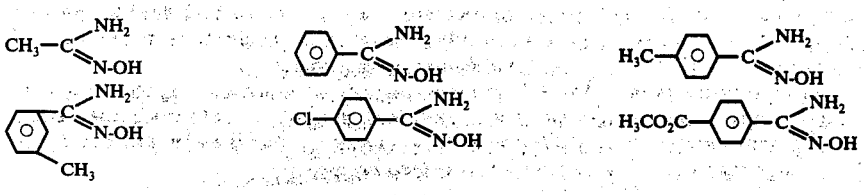

-continued

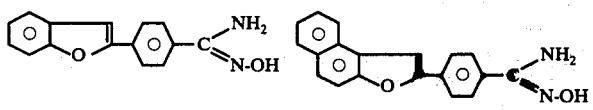

The following compounds may be used as carbonyl or halomethyl compounds of the general formula (6) and (7) respectively in the process described under (B):

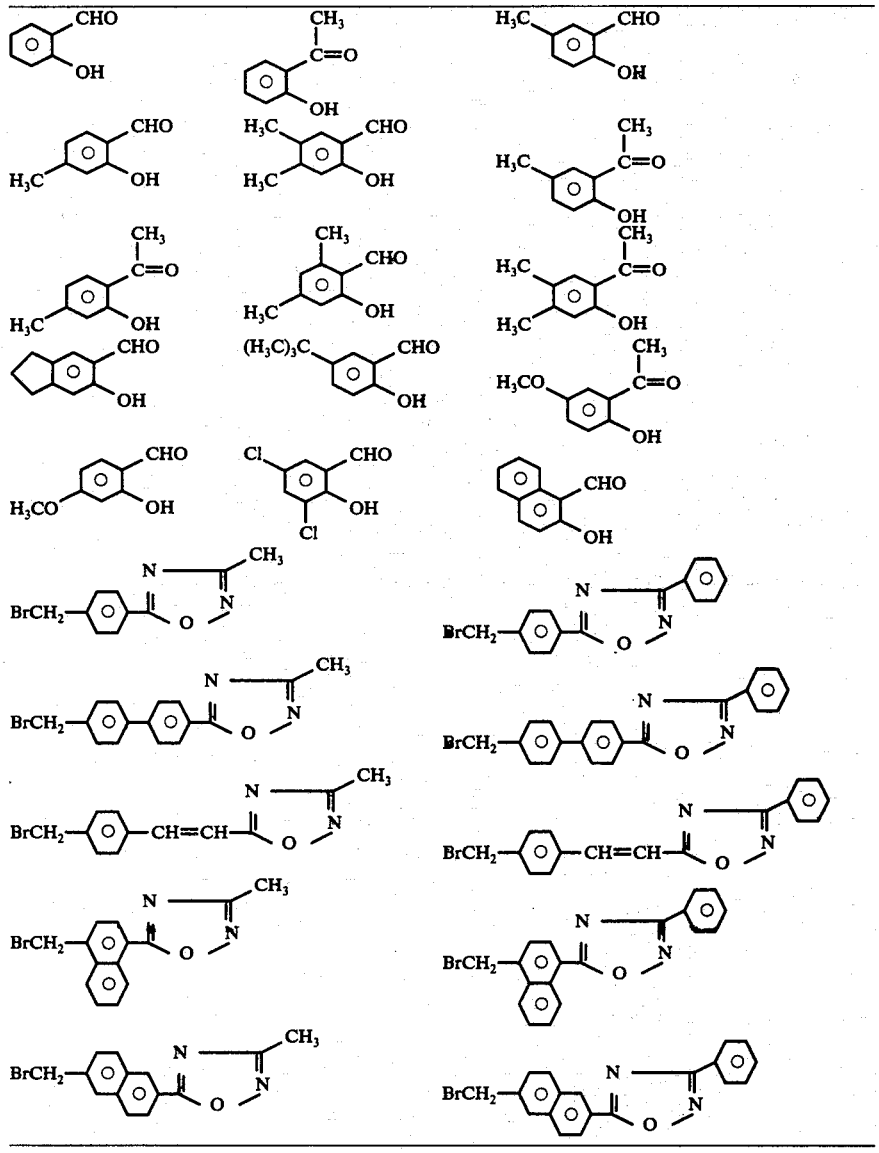

Further modifications, known per se, may be made to the reaction products of the above-described process, for example sulfonation with sulfonating agents, such as, for example, $H_2SO_4$, mixtures of $H_2SO_4$ and $SO_3$ or chlorosulfonic acid, and furthermore such modifications that, for example, starting from sulfo- or carboxy-containing molecules, result in compounds with functionally modified sulfo or carboxy groups, or the modification of such groups to form other groups of this type or to form the free acids. Furthermore, for example also in a known manner, chloromethyl groups may be introduced or methyl groups oxidized. Also successful is halogenation and other reactions of the halogen atoms introduced, for example, the exchange of chlorine or bromine for the —O≡N group or amine function.

Owing to their fluorescent property the new compounds of the invention have a wide field of application. They are chiefly used for the optical brightening of a wide variety of synthetic, semi-synthetic and natural high molecular weight materials.

There are to be understood by organic, high molecular weight materials, polymerization, polycondensation and polyaddition products as well as the after-treatment products thereof, for example:

polymerization products based on α,β-unsaturated carboxylic acids, on olefin hydrocarbons or on halogenated hydrocarbons (such as, polyolefins, polyvinyl chloride, polyvinylidene chloride, polyacrylonitrile and others);

polycondensation products based on bifunctional or polyfunctional compounds with condensible groups, the homo and mixed condensation products thereof (such as polyesters, polyamides, maleic resins, polycarbonates, silicone resins, and others);

polyaddition products, such as, for example, crosslinked or non-crosslinked polyurethanes as well as epoxy resins.

There may be mentioned as semi-synthetic organic materials, for example, cellulose esters and ethers, nitrocellulose, regenerated cellulose and plastics based on casein.

Natural materials that can be optically brightened are, for example, protein materials, such as wool, silk and leather; cellulose materials, such as cotton, paper, wood pulp in fine distribution; also rubber, gutta-percha or balata.

The organic materials to be optically brightened may be in a wide variety of processing conditions (raw materials, semi-produced products or finished products) and aggregate states, for example, in the form of plates, sheets, molded articles, shavings, granulates, foam plastics, films, foils, lacquers, webs; threads, fibers, for example in the form of endless threads, staple fibers, flocks, yarns, rope goods, twisted yarns, fiber fleeces, felts, cotton wools, textile fabrics, composite materials and knitted materials; furthermore also in the form of powders, cement, pastes, wax, adhesive compositions and knifing fillers etc.

The new optical brighteners can obviously also be used in all cases where organic materials of the above-mentioned type are combined with inorganic materials in any form.

The compounds according to the invention are, however, preferably used for the optical brightening of fibers, textiles and plastics.

Compounds of the invention insoluble in water, which are suitable especially for the optical brightening of polyester and polyamide fibers, as well as of cellulose and regenerated cellulose fibers, and cellulose and regenerated cellulose fibers finished with synthetic resins for the purpose of easy care, alone or in admixture with synthetic fibers, may be used dissolved in organic solvents or in aqueous dispersion, advantageously with the aid of dispersing agents. Suitable dispersing agents, are, for example, soaps, polyglycol ethers that are derived from fatty alcohols, fatty amines or alkyl phenols, cellulose sulfite waste liquors or condensation products of optionally alkylated naphthalenesulfonic acids with formaldehyde.

The compounds according to the invention are distinguished in particular by the fact that they can be used in the presence of oxidative and reductive bleaching agents, for example hydrogen peroxide, sodium hypochlorite and sodium chlorite, as well as sodium dithionite, without impairing the optical brightening effect. The optical brighteners may be combined with other finishing agents for the purpose of improving the effect or simplifying the process. Such auxiliaries are, for example, retarders, carriers, dispersing agents, plasticizers, olephobic and hydrophobic compounds, preparative agents, emulsifiers, washing agents and wetting agents.

Particularly good brightening effects are sometimes also obtained when the compounds of the invention are combined with other optical brighteners. Such combinations are of particular interest when changes in shade of the brightening effect are desired.

The brightening of the fiber material with the aqueous or possibly organic brightener liquor is effected either in the exhaust process at temperatures of preferably approximately 20 to 150° C or under thermosoling conditions, in which the textile material is brought to a moisture content of approximately 50 to 120% with the brightener solution or dispersion by impregnating and squeezing off or spraying. Subsequently the textile material is subjected for approximately 10 to 300 seconds to a temperature treatment, preferably by means of dry heat of approximately 120 to approximately 240° C. This thermosoling process can also be combined with other finishing operations, for example, with synthetic resins for the purpose of easy care. The brighteners according to the invention are distinguished by a high resistance to the catalysts and additives customary for this, such as magnesium chloride, zinc nitrate or also polyethylene dispersions.

Synthetic detergents may also be added to the benzofurans of the general formula (1). These may contain the customary fillers and auxiliaries, such as alkali metal silicates, alkali metal polyphosphates and alkali metal polymetaphosphates, alkali metal borates, alkali metal salts of carboxymethyl cellulose, foam stabilizers, such as alkanol amides of higher fatty acids, or complex formers, such as soluble salts of ethylene diamine tetraacetic acid or diethylene triamine pentaacetic acid, as well as chemical bleaching agents, such as percarbonates. Very good results are also obtained with perborate-containing synthetic detergents in the presence of perborate activators. Also, the customary disinfectants used in synthetic detergents do not impair the brightening effects of the compounds according to the invention.

Furthermore, the compounds according to the invention may be added to high molecular weight organic materials before or during forming. For example, they may be added when producing films, foils, webs or shaped articles from molding compositions, or they may be dissolved in the spinning composition before spinning. Suitable compounds may also be added to the lower molecular weight starting materials before the polycondensation or polymerization, as in the case of polyamide-6, polyamide-6,6 or linear polyesters of the polyethyleneglycol terephthalate type.

Compounds according to the invention that are substituted by one or preferably two carboxy or carboalkoxy groups, may be bonded to linear polyester molecules and synthetic polyamides by an ester or amide bond, if they are added to these materials or preferably their starting substances under suitable conditions. Brighteners anchored in the substrate in this manner by a chemical bond are distinguished by an extremely good fastness to solvents and sublimation.

The quantity of compounds of the general formula (1) to be used in accordance with the invention, based on the material to be optically brightened, can vary greatly depending on the field of use and the desired effect. It can be determined by a simple manner by simple preliminary tests and is generally between approximately 0.01 and approximately 2%.

The following Examples illustrate the invention in detail.

EXAMPLE 1

23.8 g of p-[benzofuranyl-(2)]-benzoic acid, 15.2 ml of thionyl chloride and one drop of DMF are heated in 150 ml of chlorobenzene for 1.5 hours at 80°-100° C. The reaction mixture is cooled to 0°-5° C., the resulting acid chloride is filtered off with suction and washed with chlorobenzene and hexane. This crude acid chloride (22 g, melting point 166°-168° C.) is heated with 11.6 g of benzamide oxime and 8.6 g of triethylamine in 250 ml of N-methylpyrrolidone for 2 hours at 160°-180°. At 0°-5° C. the resulting crystals are filtered with suction and washed with ethanol. 23.1 g of the compound of the formula (101) are obtained.

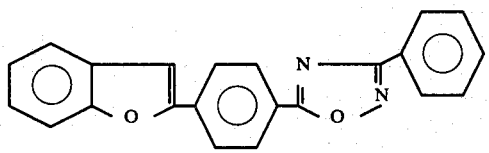

(101)

This compound is recrystallized from butanol with the addition of tonsil.

Yield: 20.6 g Melting point: 205°-206° C.

Analysis: $C_{22}H_{14}O_2N_2$ (338.4)

Calculated: C 77.9 H 4.2 N 8.3

Found: C 77.4 H 4.1 N 8.5

Absorption: γmax: 340 nm (DMF) $\epsilon = 4.4.10^4$

The compounds of the general formula (102) listed in the following Table can be produced in a similar manner.

Table 1

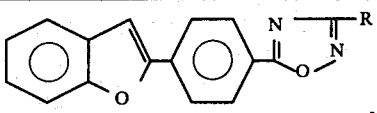

(102)

| Ex. | Formula No. | R | Analysis(%) | C | H | N | Melting point or clarification temperature [° C] | recrystallized from | Absorption in DMF λmax.[nm] | $\epsilon \cdot 10^{-4}$ |
|---|---|---|---|---|---|---|---|---|---|---|
| 2 | (102 a) | $-CH_3$ | calc. | 73.9 | 4.4 | 10.1 | 197 - 198 | toluene | 336 | 5.43 |
| | | | found | 74.1 | 4.4 | 10.0 | | | | |
| 3 | (102 b) | 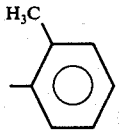 | calc. | 78.5 | 4.6 | 7.95 | 178 - 179 | BuOH | 339 | 4.37 |
| | | | found | 78.6 | 4.6 | 7.8 | | | | |
| 4 | (102 c) | 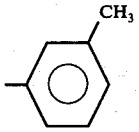 | calc. | 78.5 | 4.6 | 7.95 | 164 - 165 | BuOH | 339 | 4.29 |
| | | | found | 78.1 | 4.6 | 8.3 | | | | |
| 5 | (102 d) | 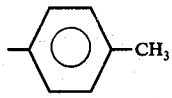 | calc. | 78.5 | 4.6 | 7.95 | 232 - 233 | toluene | 338 | 4.4 |
| | | | found | 78.4 | 4.6 | 7.9 | | | | |
| 6 | (102 e) | 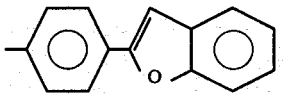 | calc. | 77.3 | 4.0 | 6.2 | 302 - 304 | DMF | 346 | 8.05 |
| | | | found | 77.1 | 3.9 | 6.1 | | | | |
| 7 | (102 f) | 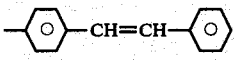 | calc. | 81.8 | 4.6 | 6.4 | 360 | DMF | 372 | 6.08 |
| | | | found | 81.9 | 4.6 | 6.2 | | | | |
| 8 | (102 g) | 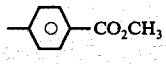 | calc. | 72.7 | 4.1 | 7.1 | 225 | tol | 341 | 4.76 |
| | | | found | 72.8 | 4.1 | 7.0 | | | | |
| 9 | (102 h) | 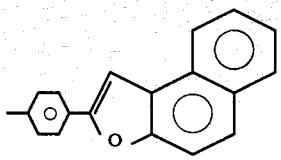 | calc. | 80.9 | 4.0 | 5.6 | 292 - 294* | DMF | 354 | 8.16 |
| | | | found | 81.2 | 4.0 | 5.4 | 362 | | | |
| 10 | (102 i) | 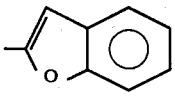 | calc. | 76.2 | 3.7 | 7.4 | 230 - 232 | DMF | 341 | 4.76 |
| | | | found | 76.1 | 3.8 | 7.4 | | | | |

*liquid-crystalline bahaviour

EXAMPLE 11

In a manner analogous to that described in Example 1 the compound of the formula (103)

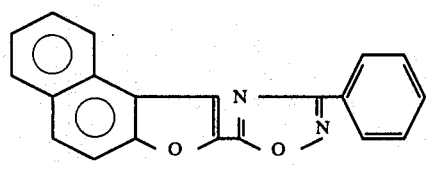

(103)

is produced from naphthofuran-2-carboxylic acid chloride of the formula

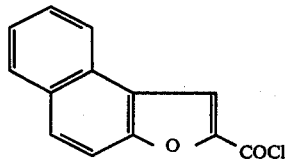

with benzamide oxime.

Yield: 51% Melting point: 183°–184° C. (toluene)
Analysis: $C_{20}H_{12}N_2O_2$ (312.31)
Calculated: C 77.1 H 3.9 N 9.0
Found: C 77.1 H 4.0 N 9.0
Absorption: γmax = 351 [nm] (DMF)

EXAMPLE 12

In a manner analogous to that described in Example 1 the compound of the formula (104) is produced from naphthfuranyl-(2)-phenyl-4'-carboxylic acid chloride with benzamide oxime

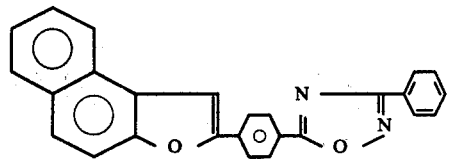

(104)

Yield: 84% Melting point: 265°–266.5° (DMF)
Analysis: $C_{26}H_{16}N_2O_2$ (388.4)
Calculated: C 80.3 H 4.15 N 7.2
Found: C 80.6 H 4.3 N 7.3
Absorption: γmax = 364 nm (DMF) $\epsilon = 4.4.10^4$ The compounds of the formula (104*a*–104*g*) listed in the following Table 2 can be produced in a corresponding manner.

Table 2

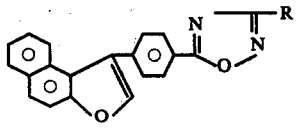

(104a) – (104g)

| Ex. | Formula | R | | Analysis C | H | N | Melting point or clarification temp. [° C] from | re-crystallized | Absorption in DMF +max [nm] | $\epsilon \cdot 10^{-4}$ |
|---|---|---|---|---|---|---|---|---|---|---|
| 13 | (104a) | $-CH_3$ | calc. | 77.2 | 4.3 | 8.6 | 221 – 223 | tol | 362 | 4.15 |
| | | | found | 77.5 | 4.3 | 8.4 | | | | |
| 14 | (104b) | 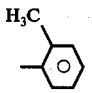 | calc. | 80.6 | 4.5 | 7.0 | 219 – 220 | DMF | 363 | 4.46 |
| | | | found | 80.7 | 4.6 | 6.9 | | | | |
| 15 | (104 c) | 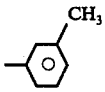 | calc. | 80.6 | 4.5 | 7.0 | 220 – 221 | DMF | 363 | 4.50 |
| | | | found | 80.6 | 4.5 | 7.3 | | | | |
| 16 | (104 d) | 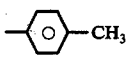 | calc. | 80.6 | 4.5 | 7.0 | 254 – 255* | DMF | 363 | 4.49 |
| | | | found | 80.6 | 4.5 | 6.8 | 261 (clear) | | | |
| 17 | (104 e) | 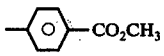 | calc. | 75.4 | 4.05 | 6.3 | 224* | BME | 365 | 4.40 |
| | | | found | 75.7 | 4.1 | 6.1 | 310 (clear) | | | |
| 18 | (104 f) | 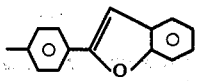 | calc. | 81.0 | 3.98 | 5.6 | 279 – 280* | DMF | 363 | 5.82 |
| | | | found | 80.9 | 3.9 | 5.6 | 368 (clear) | | | |
| 19 | (104 g) | 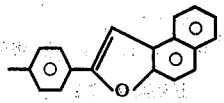 | calc. | 82.2 | 4.0 | 5.1 | 303 – 305* | DMF | 373 | 8.75 |
| | | | found | 82.5 | 4.0 | 5.0 | > 360 | | | |

*liquid-crystalline behaviour
BME = benzoic acid methyl ester

Table 3

In a manner analogous to that described in Example 1 the compounds of the fornula (105a) to (105f) listed in Table 3 are prepared

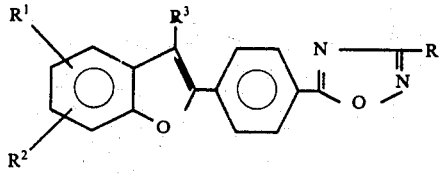

(105 a) - (105 f)

| Ex. | Formula No. | $R^1$ $R^2$ $R^3$ | R | | Analysis C | H | N | Melting point or clarification temp. [° C] | recrystallized from | Absorption in DMF λmax [nm] | $\epsilon \cdot 10^{-4}$ |
|---|---|---|---|---|---|---|---|---|---|---|---|
| 20 | (105 a) | $H_3CO$ | $CH_3$ | calc. | 70.5 | 4.6 | 9.16 | 189 | tol | 344 | 3.73 |
| | | | | found | 70.5 | 4.6 | 9.0 | 206* | | | |
| 21 | (105 b) | $CH_3$ $CH_3$ $H_3C$ | $CH_3$ | calc. | 75.4 | 5.7 | 8.8 | 147 - | EtOH | 346 | 3.21 |
| | | | | found | 75.7 | 5.8 | 8.6 | 149,5 | | | |
| 22 | (105 c) | $CH_3$ $H_3C$ | | calc. | 78.6 | 4.9 | 7.6 | 168 - 170 | tol | 349 | 3.91 |
| | | | | found | 78.2 | 4.9 | 7.6 | | | | |
| 23 | (105 d) | $CH_3$ $H_3C$ | | calc. | 79.6 | 4.6 | 5.8 | 223 | DMF | 348 | 7.08 |
| | | | | found | 79.6 | 4.7 | 5.8 | | | | |
| 24 | (105 e) | $H_3C$ | | calc. | 78.5 | 4.6 | 7.95 | 192 - 194 | tol | 343 | 4.40 |
| | | | | found | 78.5 | 4.6 | 7.9 | | | | |
| 25 | (105 f) | $H_3CO$ | | calc. | 75.4 | 4.4 | 7.6 | 182 - 184 | DMF | 348 | 4.04 |
| | | | | found | 75.7 | 4.5 | 7.2 | 264* | | | |

*liquid-crystalline behaviour

EXAMPLE 26

From the carboxylic acid of the formula (106)

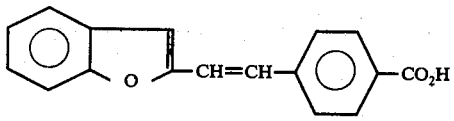

(106)

which after conversion into the corresponding acid chloride is reacted in accordance with Example 1 with benzamide oxime, the compound of the formula (107) is produced

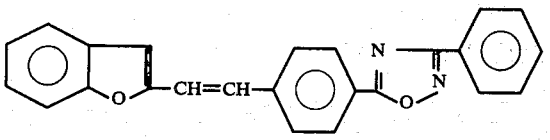

(107)

Yield: 67% Melting point: 215° C (toluene)
Analysis: $C_{24}H_{16}N_2O_2$ (364.4)
Calculated: C 79.3 H 4.4 N 7.7
Found: C 79.6 H 4.7 N 7.7
Absorption: γmax = 365 nm (DMF) $\epsilon = 4.7.10^4$

EXAMPLE 27

If the benzamide oxime in Example 26 is replaced by the equivalent amount of acetamide oxime the compound of the formula (108) is obtained.

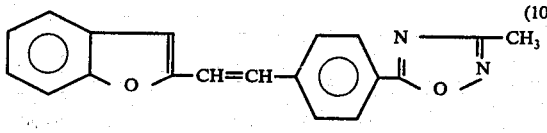

(108)

Yield: 77% Melting point: 184°-186° C
Analysis: $C_{19}H_{14}N_2O_2$ (302.3)
Calculated: C 75.5 H 4.67 N 9.3
Found: C 75.9 H 4.6 N 9.1
Absorption: γmax = 362 nm (DMF) $\epsilon = 4.83.10^4$

EXAMPLE 28

A fabric of texturized polyester was padded with a dispersion that contained 0.75 g/l of the brightener of the formula (104) and squeezed off on a foulard to a residual moisture content of 85%. It was then dried and subjected to a thermosol process for 40 seconds at 170° C. on a stenter. The material treated in this manner exhibited a considerable increase in brightness. Similar results were obtained with the same amount of compound (107).

EXAMPLE 29

A fabric of polyester-staple fiber was impregnated with a dispersion containing 0.75 g/l each of the compounds (104) and (107) or (108), or alternatively 1.5 g/l of the compound of the formula (104*a*). The fabric was squeezed off to a residual moisture content of 69%. By drying and thermosoling at 190° C. for 30 seconds, a material was obtained which exhibited a significant increase in brightness in comparison with untreated material.

Equally good results were obtained with the compounds (104*a*) and (107) in the exhaust process under high temperature conditions on polyester-staple fibers at 120° C. and on cellulose triacetate at 98° C. The liquor contained 0.15% each of the compounds (104*a*) and (107) and the liquor ratio was 1:20.

EXAMPLE 30

A polyamide fabric was treated for 1 hour on a high temperature apparatus at 120° C. and a liquor ratio of 1:20 with a liquor containing 0.15% by weight of compound (104) or (104*f*). A considerable increase in the brightness could be determined.

EXAMPLE 31

A polyester fabric was treated for 1 hour at 98° C. and a liquor ratio of 1:20 with a liquor containing, in addition to 0.15% by weight of compound (108), 1 g/l of a carrier based on o-phenylphenol. After cooling, washing and drying, a considerable increase in the brightness of the material was found.

EXAMPLE 32

30 mg of compound (108) were dispersed in 25 g of di-octylphthalate. 75 g of polyvinyl chloride, which contained 2% of titanium dioxide and 0.2% of a wax, was stirred into this paste. In addition, 1.5 g of a stabilizer were added. A rolled sheet was produced from this mixture on a cylinder mill in 10 minutes at 160° C. This sheet exhibited a significantly higher degree of brightness than a sheet of the same composition but without brighteners.

What is claimed is:

1. A compound of the formula

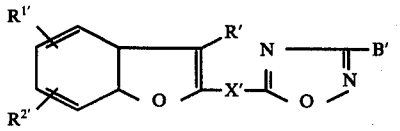

(2)

in which $R^{1'}$ and $R^{2'}$ is H, lower alkyl, lower alkoxy, halogen, carboxy, cyano, carbo lower alkoxy, carbamido, mon- or di-lower alkyl carbonamido, sulfo, sulfonamido-, mono- or di-lower sulfonamido, sulfonic acid lower alkyl ester or phenyl, or $R^{1'}$ and $R^{2'}$ together represent a fused benzene nucleus R' represents H or lower alkyl X' represents one of the following divalent groups

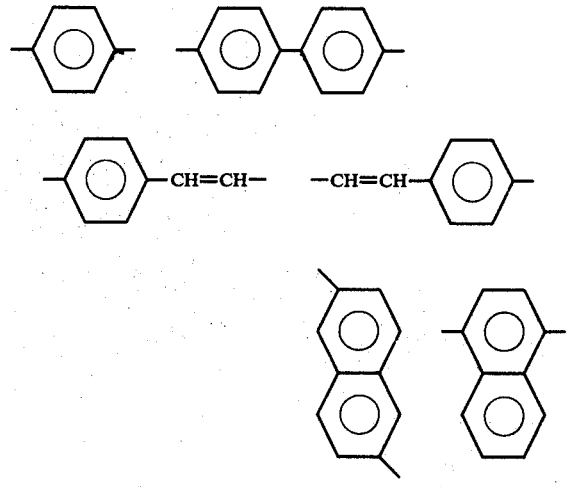

and

B' is $C_1$–$C_6$ alkyl, lower alkoxy lower alkyl, phenyl, alkyl phenyl, lower alkoxy phenyl, cyano phenyl, halophenyl, carbo lower alkoxy phenyl, styrylphenyl or a group of the formula

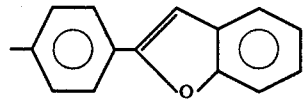

or

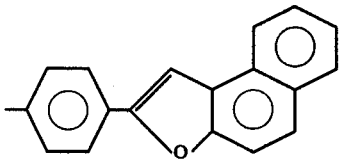

2. A compound of the formula

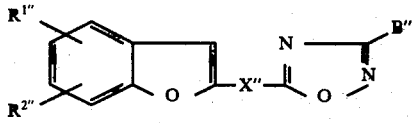

(3)

in which $R^{1''}$ and $R^{2''}$ represent hydrogen, $C_1$–$C_4$ alkyl, $C_1$–$C_4$ alkoxy, halogen or a phenyl ring fused in the 4,5-position;

X'' represents one of the following divalent bridge members

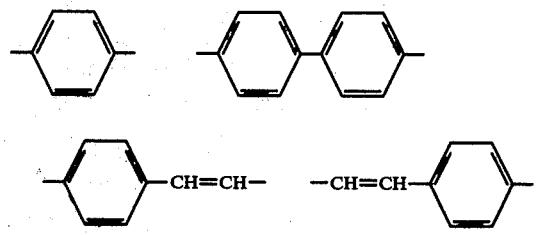

-continued
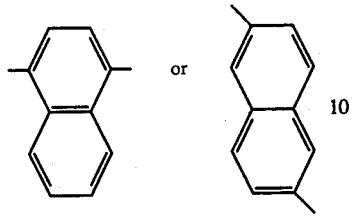
and
B'' represents $C_1$–$C_6$ alkyl, $C_1$–$C_4$ alkoxyalkyl, phenyl, $C_1$–$C_4$ alkylphenyl, halophenyl or $C_1$–$C_4$ carboalkoxyphenyl or a group of the formula
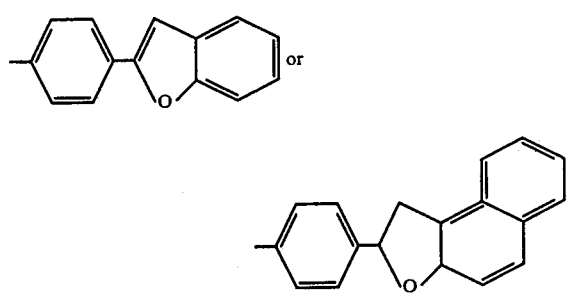
* * * * *